US006785945B2

(12) United States Patent
Reichel et al.

(10) Patent No.: US 6,785,945 B2
(45) Date of Patent: Sep. 7, 2004

(54) METHOD FOR PRODUCTION OF A CONNECTOR POINT ON A TRAVEL WAY

(76) Inventors: Dieter Reichel, Badstrasse 13, D-92318 Neumarkt, Deutschland (DE); Theo Frisch, Windbergstrasse 12, D-92355 Velburg, Deutschland (DE); Jürgen Feix, Waldstr. 44, D-82110 Germering, Deutschland (DE)

( * ) Notice: Subject to any disclaimer, the term of this patent is extended or adjusted under 35 U.S.C. 154(b) by 0 days.

(21) Appl. No.: 10/169,822

(22) PCT Filed: Aug. 3, 2001

(86) PCT No.: PCT/EP01/09009

§ 371 (c)(1),
(2), (4) Date: Oct. 29, 2002

(87) PCT Pub. No.: WO02/12628

PCT Pub. Date: Feb. 14, 2002

(65) Prior Publication Data

US 2003/0121151 A1 Jul. 3, 2003

(30) Foreign Application Priority Data

Aug. 4, 2000 (DE) ..... 100 38 851

(51) Int. Cl.[7] ..... B23Q 17/00; B61B 13/04

(52) U.S. Cl. ..... 29/404; 29/407.05; 104/120

(58) Field of Search ..... 104/120, 124; 29/897.3, 407.05, 407.09, 897.2, 404, 722

(56) References Cited

U.S. PATENT DOCUMENTS

| | | | |
|---|---|---|---|
| 3,212,390 | A | 10/1965 | Litzkow |
| 3,841,223 | A | 10/1974 | Bertin |
| 3,890,904 | A | 6/1975 | Edwards |
| 4,375,193 | A | 3/1983 | Sullivan |
| 4,620,358 | A | 11/1986 | Miller et al. |
| 4,631,772 | A | 12/1986 | Bonasso |
| 4,698,895 | A | 10/1987 | Miller et al. |
| 4,854,028 | A | 8/1989 | Buchler et al. |
| 4,856,173 | A | 8/1989 | Maier et al. |
| 4,870,906 | A | 10/1989 | Schaffer et al. |

(List continued on next page.)

FOREIGN PATENT DOCUMENTS

| | | |
|---|---|---|
| CH | 653729 | 1/1986 |
| DE | 928047 | 4/1955 |
| DE | 2216484 | 10/1973 |

(List continued on next page.)

OTHER PUBLICATIONS

International Preliminary Examination Report, Aug. 5, 2002.

U.S. patent application Ser. No.: 10/049,096, Jun. 18, 2002.

U.S. patent application Ser. No. 10/049,096, filed Jun. 18, 2002.

(List continued on next page.)

*Primary Examiner*—David P. Bryant
(74) *Attorney, Agent, or Firm*—Dority & Manning

(57) ABSTRACT

A method for producing a beam for a travel way in a track vehicle system includes fabricating the beam at a production facility with dimensions corresponding to erected dimen sions the beam will have at its construction site, or within a predetermined deviation from the erected dimensions. The beam is positioned in the position it will have in its erected state in the travel way at the construction site. Positions for connection points are measured and defined on the beam for appurtenances so that such appurtenances and functional surfaces will have a desired relative position on the beam in its erected state at the construction site. The connection points are reworked by adding or removing material as required so that upon mounting the appurtenances to the beam at the connection points, the appurtenances and functional surfaces will have the desired relative position on the beam at the construction site.

15 Claims, 4 Drawing Sheets

U.S. PATENT DOCUMENTS

| | | | |
|---|---|---|---|
| 4,905,359 | A | 3/1990 | Maier et al. |
| 4,909,474 | A | 3/1990 | Buchler et al. |
| 4,970,773 | A | 11/1990 | Buchler et al. |
| 4,987,833 | A | 1/1991 | Antosh |
| 5,027,713 | A | 7/1991 | Kindmann et al. |
| 5,131,132 | A | 7/1992 | Kindmann et al. |
| 5,370,059 | A | 12/1994 | Raschbichler et al. |
| 5,437,072 | A | 8/1995 | Dinis et al. |
| 5,651,318 | A | 7/1997 | O'Donohue |
| 5,823,114 | A | 10/1998 | Cioletti et al. |

FOREIGN PATENT DOCUMENTS

| | | | |
|---|---|---|---|
| DE | 3322019 | A1 | 12/1984 |
| DE | 3412584 | A1 | 10/1985 |
| DE | 3639265 | A1 | 6/1988 |
| DE | 3709619 | A1 | 10/1988 |
| DE | 3825508 | C1 | 10/1989 |
| DE | 3924486 | C1 | 1/1991 |
| DE | 4021834 | A1 | 1/1992 |
| DE | 4115935 | A1 | 11/1992 |
| DE | 4115936 | A1 | 11/1992 |
| DE | 92177921 | | 8/1993 |
| DE | 4238310 | A1 | 3/1994 |
| DE | 29612404 | | 10/1996 |
| DE | 19619866 | | 11/1997 |
| DE | 19805086 | | 7/1998 |
| DE | 29809580 | | 10/1998 |
| DE | 19841936 | | 4/2000 |
| DE | 19919703 | | 11/2000 |
| EP | 0987370 | A1 | 3/2000 |
| GB | 2109437 | | 6/1983 |
| WO | 9951455 | | 10/1999 |
| WO | 0001888 | | 1/2000 |
| WO | 0020688 | | 4/2000 |

OTHER PUBLICATIONS

Dywidag–Berichte VIII, 1969, Nr. 2.
Patent Abstracts of Japan No. M–1126, Jun. 20, 1991.
U.S. application Ser. No. 10/129,997, May 13, 2002.
U.S. application Ser. No. 10/129,886, May 10, 2002.
U.S. application Ser. No. 10/169,851, Jul. 9, 2002.
U.S. application Ser. No. 10/129,999, May 13, 2002.
German Patent Office Search Report, Jun. 5, 2001.

METHOD FOR PRODUCTION OF A CONNECTOR POINT ON A TRAVEL WAY

FIELD OF THE INVENTION RECEIVED

The present invention concerns a method in accord with tracked vehicles.

BACKGROUND

Generic travel systems of the type of this invention are mostly constructed as elevated railways. Elevated railways customarily possess columns which are spaced across from one another, between which are located beams which pick up the railway design loadings imposed on them. These beams reach longitudinally from column to column. The columns and the beams are subjected to both static and dynamic operational forces. On this account, they must be dimensioned to meet the magnitude of the imposed loads. The beams, in many cases, especially where magnetically levitated high speed vehicles are concerned, must also be fitted with functional components for said vehicles. These components, to carry out their function, can allow only a very small deviation of position. Consequently, in the construction of the beams, together with their functional appurtenances, it is very difficult to maintain the required close tolerances in an economical number of preparatory steps.

When such travel ways have been constructed for a relatively long operational life, because of shrinkage and creep processes, in both the foundations and in the structures thereon, it is very difficult to maintain or guarantee the relative small tolerances in the dimensioning of the travel way for its entire operating life.

EP 0 410 153 A1 discloses a beam construction for the travel way of a tracked vehicle. The necessary beams are, in accord with the embodiment, either made in steel or in concrete. Necessary appurtenances, in this disclosure, are affixed precisely in position on the beams. To this end, it is proposed in the application, that on the beam connection bodies first stop plates be attached. These first stop plates correspond with second stop plates, which are placed on transverse members carrying the appurtenances. After the units with the first stop plates are fastened to the beam, then these first stop plates are machined, so that the required tolerances for the installation of the appurtenances maintained. The machining of the stop plates may be advantageously carried out in an air conditioned fabrication facility under controlled climate conditions. The disadvantage of this procedure lies in the following. Although it is true that the machining of the stop plates is indeed possibly exact where the beams are concerned, after erection of the beams on the construction site, deviations may be expected. These deviations originate especially in the use of prefabricated concrete beams, pretensioned concrete beams, or even steel reinforced beams. These deviations can, for instance, arise from the deformation of the individual steel reinforced concrete beams during placement on the support columns. If, upon the erection of these steel reinforced beams, a vertical or horizontal offset arises, then the previously exactly machined stop plates are no longer within the allowed tolerances relative to the complete travel way. This problem was not recognized in the EP 0 410 153 A1.

SUMMARY

Consequently, a purpose of the invention is to create a possibility of maintaining the required tolerances during the construction of a generic travel way, not only in relation to the beams, but also in relation to the complete travel way.

By the expression "erected condition",the condition of the beam, or another travel way component, is to be understood in accordance with a conventional erection of a travel way of a rail-bound vehicle. This means, the measurements of the beam, and/or of the travel way components at the time when the beam is installed and positioned on the support columns and after a state of equilibrium has been reached as to shrinkage and warping of the concrete beam and of the travel way components. The term, "reworked condition" indicates the state of the beam and the travel way components during machining of steel and/or concrete, when the state of equilibrium or the individual positioning of the reworked component during the said machining is not yet attained.

In accord with the invention, the beam is essentially shaped to correspond with its final structural position, or erected with a known deviation from its later dimensioning. The position of the connection points between the beam and the appurtenances is measured and, if required, conformation is made to prescribed dimensions of said connection points. This specified measure is carried out, so that at the connection point material may be removed or added. By the invention, the special advantage is achieved, in that the beam can be constructed in a fabrication hall to the most extreme precision, wherein the climatic conditions are of the best to obtain very small tolerances. These small tolerances, especially in the case of magnetically levitated travel ways, are very important in order that a trouble-free operation of the magnetically levitated equipment can be assured. In accord with this, it is not sufficient to merely hold to this exact dimensioning in the air-conditioned fabrication hall. Therefore the next step would naturally be to advantageously situate the beam in the same position that it will be positioned in the travel way in accord with predetermined measurements. Thus, during rework of the connection points, the beam is positioned in the same manner as in its final erected situation. Thus, the deformations such as might be expected on the construction site, for the individual beam, are still in force during the working of the connection points. In this way, the beam is provided with predetermined dimensioning for connection points, as will be required of the said beam in the final erection when the travel way is constructed.

Alterative, the deviation between the rework position of the beam and the later erected position can be determined by computer and taken into consideration when the connection points are machined. The connection points of the beam in such a case are reworked with a defined variance between the later specified dimensioning and the actual reworked dimensions. The deviation takes into consideration the different positioning as held during rework and the later erection of the beam. Then, when the beam is erected in its foreseen place, the measurements required in the field agree with the actual measurements of the beam; that is, with the connection points thereon. By means of the invented procedure, the most precise fabrication of the connection point for a travel way—especially for magnetically levitated ways—is obtained. With the invented procedure, individual beams can be custom made, which are intended to be erected in a specific place in the travel way. This guarantees the greatest, degree of precision and thereby assures reliable operation, especially where magnetically levitated vehicles are concerned.

In accord with a further invented procedure following in another embodiment, an exact positional dimensioning can be made between connection points for the fastening of appurtenances or between functional surfaces on the beam for the vehicle. In this case, a specified dimension for the erected condition of the beam is predetermined. If the erected condition of the beam is seen to deviate from the said specified dimension, then a second specified dimensioning is determined for the rework condition. The specified dimensioning of the connection points or the functional surfaces in the machining condition of the beam is determined, and as may be demanded, the required first or second specified dimension becomes the basis for the rework condition of the beam. In this way material at the connection point or on the function surfaces is removed or replenished. The rework of the connection point can be either on the beam itself or on a console between the beam and the functional surfaces, or on an added appurtenance which bears the said functional surface, or indeed, on the appurtenance itself. The same is valid for the procedure in accord with the embodiment above. Where the case concerns the fact that the erection condition and the rework condition are identical, then the first and the second predetermined dimensioning must be identical. Thus the rework then can be carried out in such a manner that the predetermined measurement as it should appear in the erected condition of the beam is achieved by the rework.

Since, for the operation of the vehicle it is especially important that the functional surfaces be exactly positioned, at this point it can be particularly advantageous if the functional surfaces themselves are subjected to measurement and the rework operation carried out accordingly and in keeping with these functional surfaces. In this way, fine tolerances can be eliminated, which must be held between the connection point and for example an appurtenance, which carries the functional surface. Thus an optimal condition for the functional surfaces is obtained within the travel way.

It is of particular advantage if the beam when positioned for rework, is in correspondence with its later erected position. To this end, a computation between the predetermined value of the erected position and the predetermined value in the machining condition can be omitted, since these two dimensioning are identical.

Customarily, the measurements to be achieved by machining, concern: the outside dimension between two oppositely disposed connection points or functional surfaces, an angle, and a separating distance of a connection point to a previous or following connection point as seen in the in the longitudinal direction of the travel way.

These dimensions customarily characterize the exact guidance of the vehicle, so that these dimensions underlay the machining, in order to obtain an exact guidance of the vehicle.

In order to maintain an exact specified dimension it is an advantage if reference points, that is lines or planes or a centerline of the beam is determined, from which reference means the specified measurement can be laid down. In this way, appurtenances or the functional surfaces are correct, but the position is now referred to the beam. This way, an offset could occur which would prevent the exact guidance of the vehicle.

If the beam is a precast concrete part, then it is especially an advantage if before the rework of the beam, or the machining of the connection points on the beam, the precast concrete beam be initially stored until any shrinkage has ceased. By this means what is achieved is that by a change in the beam the reworked specified dimensioning must also change. If the shrinkage of the beam is predominately at an equilibrium state, then when the rework is carried out, a change in the dimensioning of the beam is no longer to be feared and the specified measurements can accordingly be maintained. If the beam is let lie for some 60 days before the rework is done, the shrinkage of the beam is essentially over and the rework can be carried out with exact results.

If the appurtenances following the rework of the connection points but prior to the erection of the beam are placed in the travel way then once again a dimensional monitoring of the appurtenances can take place, especially of the functional surfaces. Assurance may be made that the functional surfaces are placed on the beam in a precise manner. If necessary, the functional surfaces can be reworked.

It is particularly advantageous if the appurtenances are measured magnetically. In this way, especially in the case of magnetically levitated travel ways, measurements are made of a stator packet to determine its magnetic field. The magnetic field is the criterion for exact guidance of the vehicle of a magnetically levitated travel way so that by means of the magnetic measurement a particularly precise guidance of the vehicle is made possible. The specified measurement, in the respect, directs itself in accord with the actual magnetic field of the travel way.

If the material at the connection point between the beam and the appurtenance is removed or built up sequentially when the required measurement has been reached, the appurtenance is mounted. For this mounting, a secure and stable connection point is created, which is dimensionally correct with even the small tolerances necessary for the safe operation of the magnetically levitated travel system. One particular advantage of the invention is that the connection point at the construction site has the proper dimensions.

It is favorable if the measurement or the rework of the connection point is carried out by means of a tracked vehicle. The tracked vehicle is guided along the beam and by this method effects an exact dimensioning and rework of the connection position.

It is of particular advantage if the connection point is provided with a console connected to the beam. The console, in this service, can be advantageously shaped, so that it is particularly well adapted to the measurement of the connection position and the rework of the same. Also, the material selection of the console is independent of the properties which the beam must fulfill. Thus the said material must be so chosen that the rework and the connection with the appurtenance is optimal.

By means of a particular formulation of the console, the connection point can be mechanically reworked on the console either before or after it is mounted on the beam. This allows for example a first pre-machining, and a subsequent mounting of the console on the beam and if necessary a second machining of the connection point.

Normally, the material is removed by machine cutting, that is by milling or boring to dimension the corresponding connection points. However, the rework of the connection point can be done by means of a laser or other metal working methods.

If required by the selection of appropriate materials of the console, the connection point material can be welded when connected to the beam. By this means, a deficiency in the dimensioning can be compensated for.

In case of such a deficiency in dimensioning, also an additional object can be inserted in the role of a spacer. Adaptable to this service would be a thin section or a shim plate. This additional material can, for instance by welded onto the connection point and subsequently be again cut back, if necessary, to the specified dimensioning.

If the measurement and the rework is carried out after the end of the deformation procedure, i.e., that deformation due to creep and shrinkage, then a long lasting retention of the correct specified dimensioning will be achieved and the tolerances reliably maintained since the material will no longer be subject to dimensional change. Further, this a special advantage of the present invention since in accord with the state of the technology, further deformations are to be contended with where rework of the corresponding connection points is carried out immediately after fabrication in a plant, especially in the case of concrete work. These changes come to an essential equilibrium only after several weeks, so that the normal period between the fabrication and the time of erection of the beam is advantageous since upon the erection of the beam these internal deformations are predominately ended.

The measurement of the connection position is carried out essentially from reference points, reference lines or guide planes. This assures that the required measurements are correctly maintained. A tracked measurement/rework vehicle orients itself on the reference points, reference lines or guide planes, in accord with one concept of the invention in order to carry out measurements.

Following the above, the connection of the consoles with the beams is accomplished, and the carrying-elements are attached to the consoles after the full cure and associated shrinkage of the concrete has taken place. In this way, the positional changes brought about by the deformation of the concrete can be avoided.

The invention offers because of its modular construction the additional advantage, that the consoles and the carrying elements can be mechanically reworked before as well as after their mounting. Even extreme tolerance requirements permit themselves to be easily fulfilled hereby in all space axes. The modular construction makes possible, besides more exact and economical fabrication, a simple replacement for accidentally damaged carrying elements for the functional pieces.

Finally, the space curve for the functional plane can be well brought about by appropriate formation and/or rework of the console abutments.

In order to even out large positional changes, different consoles can be provided, which possess webs of different lengths. In this way, in the case of a large offset of the beam on its specified position, an oversized console can be can be installed which finally fastens the appurtenance in its desired position.

In order to acquire a high degree of stability in the fastening of the console on the beam, it is particularly of advantage if the beam is made of fiber reinforced concrete. Fiber reinforced concrete acts in the present case so that even in flange areas of the beam to which the console is attached a substantial structural strength of the concrete is obtained However, the console must not compromise the conventional structural properties of the beam, in order to obtain a good stability.

Further advantages and embodiments of the invention are described in the following.

DETAILED DESCRIPTION

Figure 1:
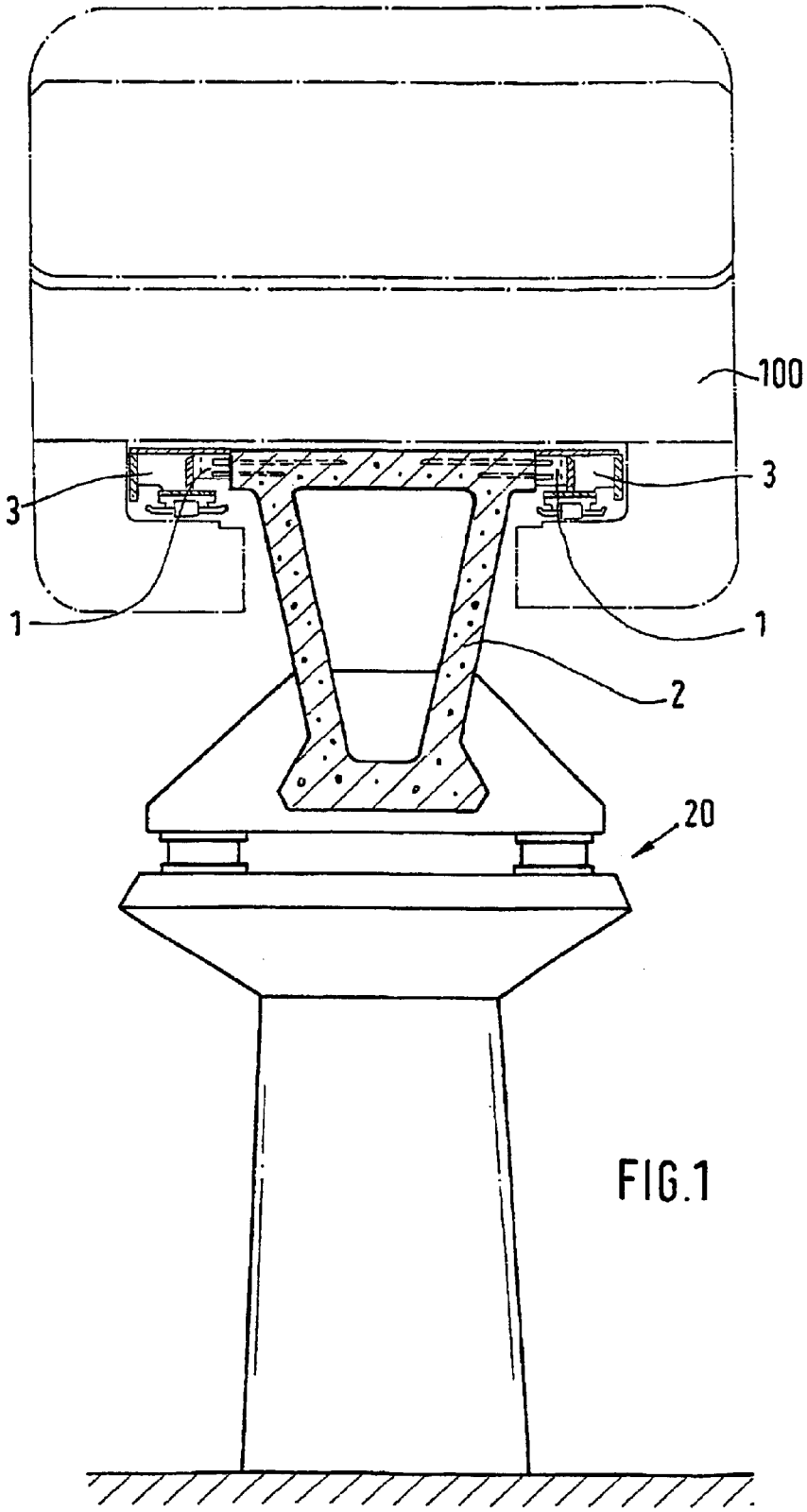
FIG. 1 an invented travel way for a magnetic levitation vehicle.

Reference now will be made to the embodiments of the invention, one or more examples of which are illustrated in the drawings. Each example is provided by way of explanation of the invention, not as a limitation of the invention. For example, features illustrated or described as part of one embodiment may be used with another embodiment to yield still a further embodiment. It is intended that the invention include these and other modifications and variations.

In FIG. 1 a travel way is shown in end view for a magnetic levitation vehicle 100, with the beam 2 presented in cross-section. The magnetic levitation vehicle 100 embraces appurtenances 3 which are fastened on each side of a beam 2. The fastening of each is carried out by means of console 1, which is embedded in the concrete of beam 2. The beam 2 is a prefabricated concrete part which is supported when erected on the construction site, on a pillar 20 or its equivalent. In order to assure the proper operation of the magnetic levitation vehicle 100, it is of importance, that the appurtenances 3 be placed in a defined position in relation to one another and to the beam 2. Only this relatively exact arrangement of the appurtenances 3 makes the operation of the magnetic levitation vehicle 100 at an extremely high velocity reliable. The appurtenances 3 have the following components: resting surfaces, side guide surfaces and stator packets with their fastenings to the beam, generally through the consoles. These parts of the appurtenances enable the guidance and drive of the magnetic levitation vehicles 100.

Figure 2:
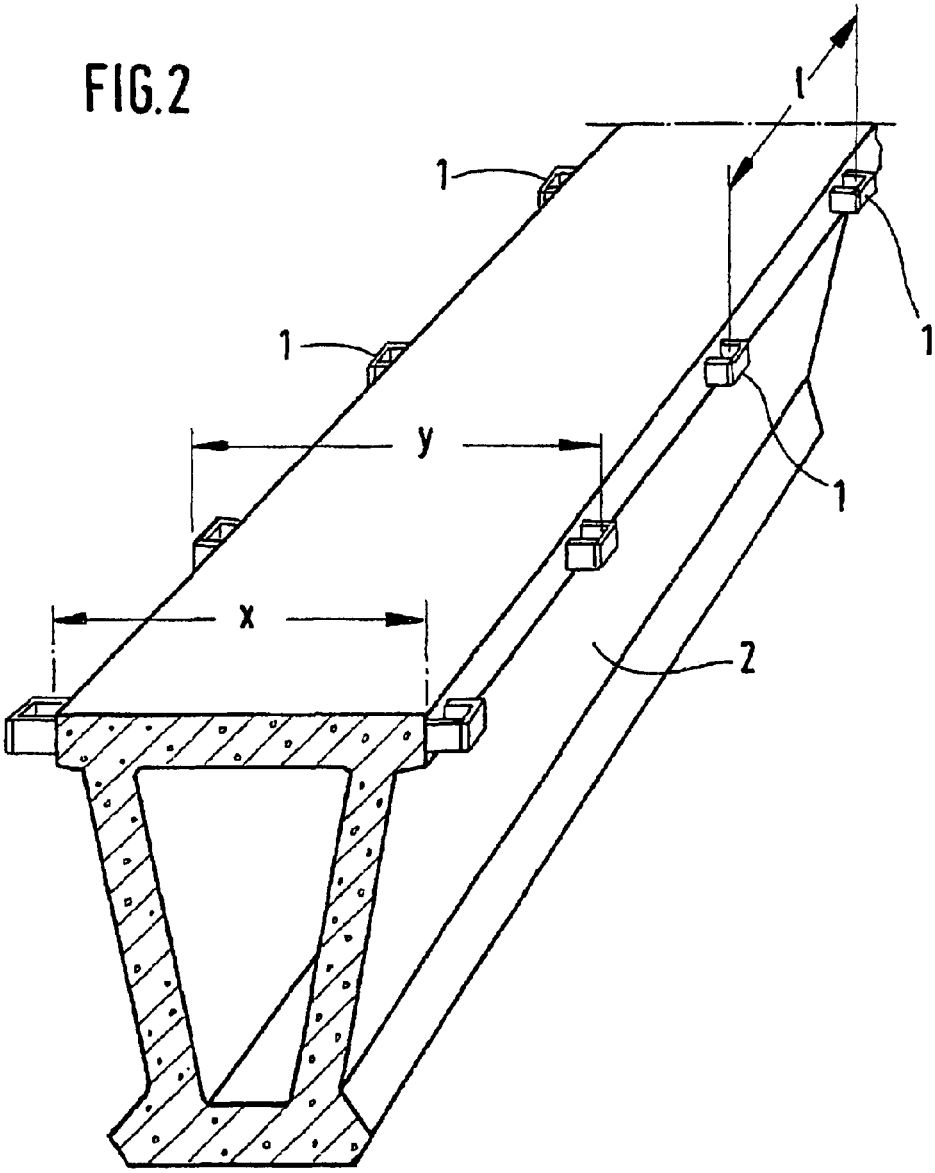
FIG. 2 a beam with consoles.

In FIG. 2 is a sketch of a beam 2 in a perspective view. On the beam 2 is placed a multiplicity of consoles. The beam 2 is designed as a hollow beam, in order to bring about a high degree of stability. By this means, very large flange widths can be achieved, by which the manufacturing costs of a travel way of this kind can be reduced. The consoles 1 are respectively placed at the sides of the upper flange of the beam 2. They are located along the longitudinal extension of the beam at a separating distance of L from one another. This length L is advantageously so selected, that it forms a whole number for the count of the positions of the appurtenances 3. By this means, assurance is given, that the appurtenances 3, which are essentially shorter than is the beam 2, are always placed in conjunction with a console. In this combination, an exact connection and interrelation of the parts is possible without the necessity of additional components. This makes the economical construction of the travel way easier since no separate connection means for the appurtenances are necessary.

The upper flange of the beam 2 exhibits a width x (FIG. 2), which is less than the breadth y of the outer surfaces of the consoles 1. On the outside surfaces (connection points) of the consoles 1, the appurtenances 3 are installed. On this account, the measurement y is important for the required measurement for the placement of the said appurtenances 3. By a change in the measurement y, the horizontal separating distance of the appurtenances is changed, which is very important for the exact guidance of the magnetic levitation vehicle 100.

The modular construction allows the consoles 1 to be fastened independently of the concrete forms for the beam 2. This is done on a separate auxiliary framework, where the consoles 1, for instance, can be positioned at variable dimensions in elongated slots in said auxiliary construction in the x-, y- and z-directions. By this means, assurance is given, that the space curve necessary for the appurtenances 3 can be constructed independently of the shape and exactitude of the beam 2 before it is cured.

Figure 3:
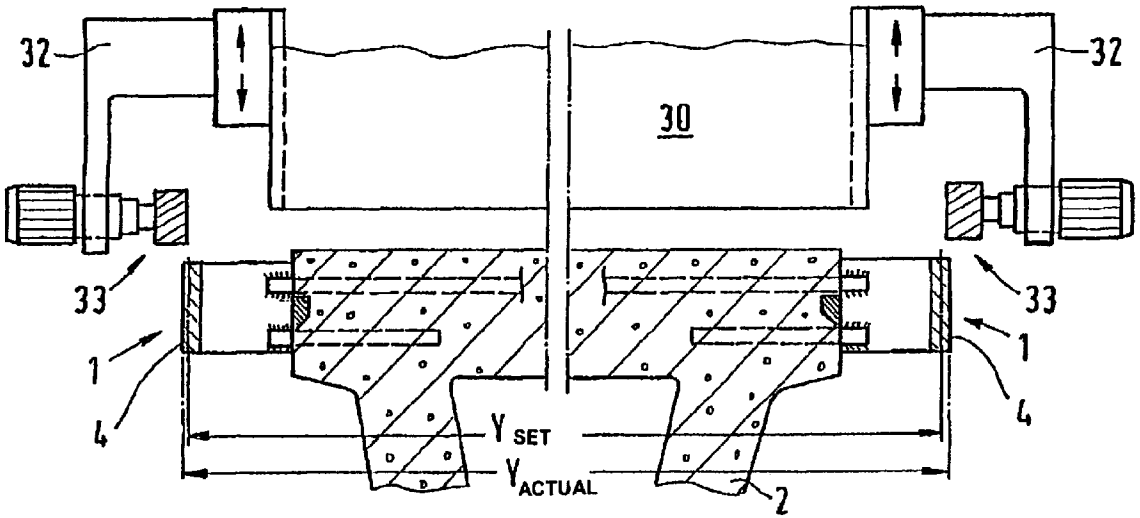
FIG. 3 a sketched rework machine for the consoles.

In FIG. 3 is sketched an apparatus for the rework of the consoles 1. Shown here is a vehicle 30 above the beam 2, for instance on rails which are not shown. The vehicle 30 measures the separating distance of the outside surfaces of the head plates 4 of the consoles 1 and determines a $y_{actual}$ value. By a procedure enacted on a cutter 33, which is set on an arm 32 of the said vehicle 30, the coordinates for a $y_{set}$ value are registered. Subsequently, by lowering the arm 2 to the area of the console 1, the head plate is cut away, until the measurement $y_{set}$ is reached. For the measuring off of the distances of $y_{set}$ and $y_{actual}$, the vehicle 30 operates from a defined reference point, reference line or reference plane. In this way, for example, the goal is achieved that in relation to the longitudinal centerline of the beam 2, the head plates 4 are symmetrically placed after the machining and do not deviate from the distance based on said centerline.

Figure 4:
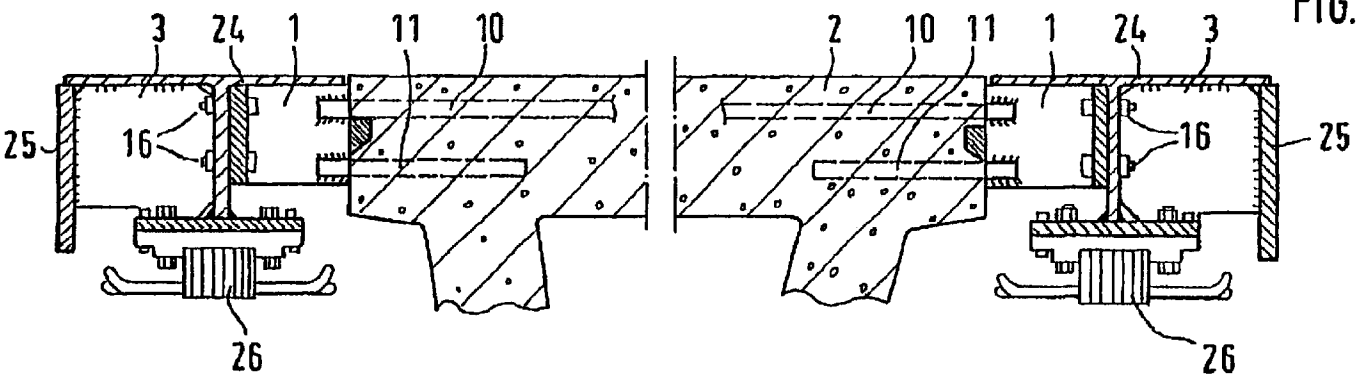
FIG. 4 a fastening of appurtenances to the consoles.

FIG. 4 shows the beam 2 with respectively a console 1 and an appurtenance 3 placed thereon. The console 1 is anchored in the beam with tie-bars 10 and 11. The appurtenance 3 possesses respectively, an upper rest surface 24, a side guide surface 25 and a stator packet 26. The stator packet 26 is placed on a corresponding fastening surface of the appurtenance 3. The appurtenance 3 is essentially built in box-shape, so that a very compact and stable form of construction is achieved. The appurtenance 3 is fastened to the console 1 by means of the bolts 16. In the case of damage to the appurtenance 3 or the beam 2, appurtenance 3 and the beam 2 can be separated from one another by means of these bolts.

Figure 5:
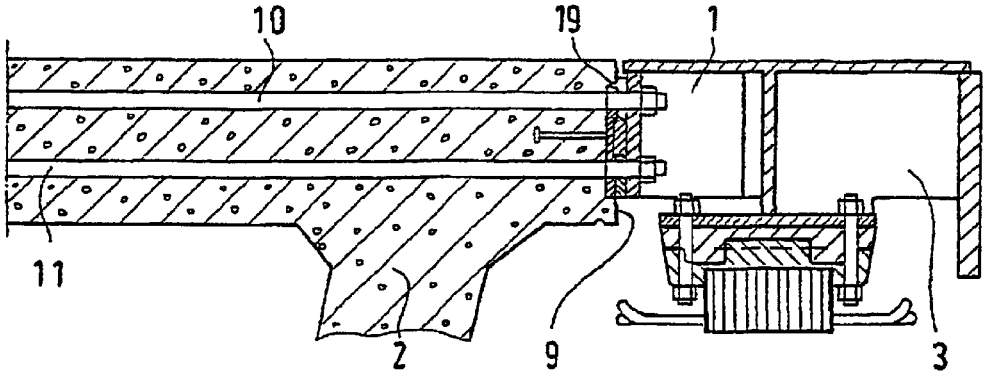
FIG. 5 a further fastening of the appurtenances to the consoles.

In the case of the embodiment of FIG. 5, the console 1 is again anchored by the tie bars 10, 11, which, this time, penetrate through the upper flange of the beam 2. The tie bars 10, 11 are here at least end threaded rods of steel, which bind together the console 1 as well as the corresponding console 1 which is oppositely situated on the other side of the beam 2. It is possible, that within the flange of the beam 2, hollow pipes can be embedded in the concrete (not shown here) through which the said threaded rods 10 and 11 penetrate and subsequently the consoles 1 can be threadedly engaged with one another.

For the support of the consoles 1, abutment plates 19 can be embedded in the side wall 9 of the beam 2, in order to assure a good support of the console 1 on the beam 2. For the purpose of adjustment, spacer plates can be inserted between the said abutment plate 19 and the console 1.

Figure 6:
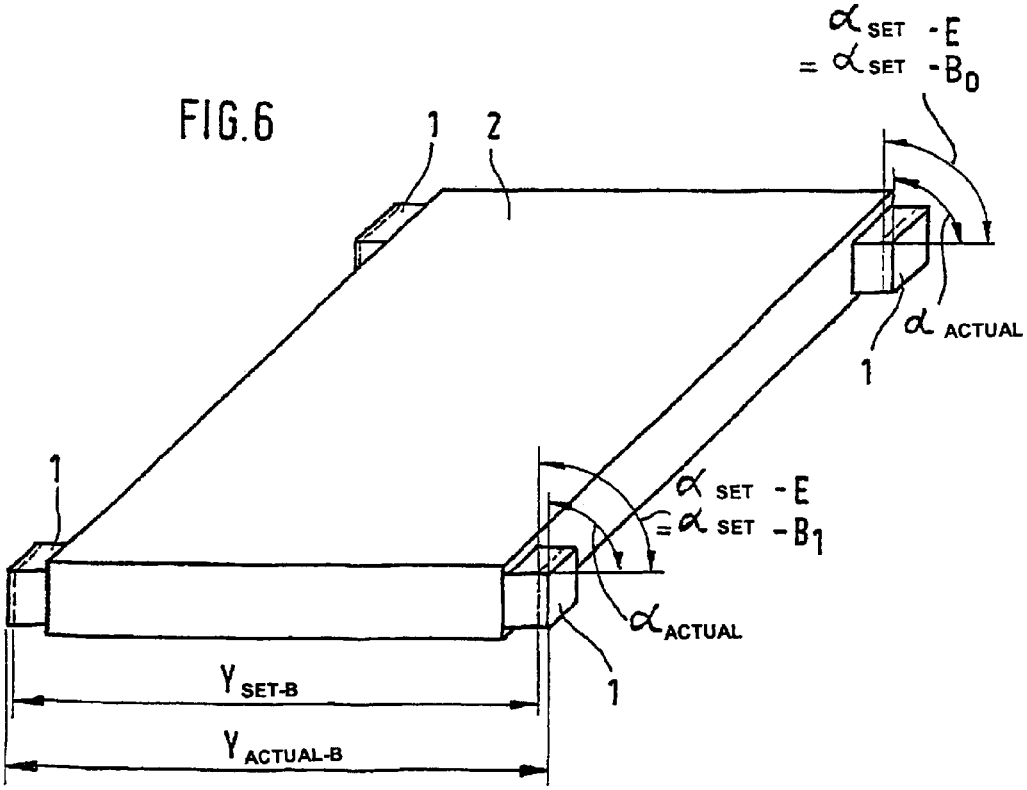
FIG. 6 a portion of a beam.

In FIG. 6 is shown a portion of a beam 2. On the beam 2, consoles 1 are shown. The consoles 1 lie across from one another and are fastened to the beam 2. The consoles 1 exhibit an outside distance apart which is designated by $Y_{actual\text{-}B}$. The consoles 1 should in this case be so reworked, that they adhere to a $Y_{set\text{-}B}$. Moreover, in the present presentation, there is also an angle a provided which refers to an imaginary reference plane. If the set angle $\alpha_{set\text{-}B}$ in the rework stage at the one end of the beam 2 differs from the angle at the other end of the beam 2 (namely $\alpha_{set\text{-}B1}$, $\alpha_{set\text{-}B0}$), then by this data, a twist of the beam 2 in the erection condition can be compensated for. If the beam 2 is installed in a twisted state in the travel way, then the two connections will align with one another. The twisting of the beam 2 is compensated for by this means.

It should be apparent to those skilled in the art that modifications and variations can be made to the embodiments of the invention described herein without departing from the scope and spirit of the invention as set forth in the appended claims and their equivalents.

What is claimed is:

1. A method for producing a beam for a travel way in a tracked vehicle system wherein appurtenances and functional surfaces defined by the appurtenances for guidance of a vehicle on the travel way are exactly positioned on the beam, said method comprising:

fabricating the beam at a production facility with dimensions corresponding to erected dimensions it will have at a construction site;

erecting the beam in the production facility to a position it will have in its erected state in the travel way at the construction site, or within a predetermined deviation from the erected state in the travel way at the construction site;

with the beam in its erected state in the production facility, measuring and defining positions for connection points on the beam for the appurtenances such that the appurtenances and functional surfaces will have a desired relative position on the beam in it erected state at the construction site; and reworking the connection points by adding or removing material as required so that upon mounting the appurtenances to the beam at the connection points, the appurtenances and functional surfaces will have the desired relative position on the beam at the construction site.

2. The method as in claim 1, comprising determining a first specified set of measurements for the appurtenances or functional surfaces for the beam as erected at the construction site, measuring the actual first set of measurements as it is positioned at the production facility; and reworking the connection points until the actual first sect of measurements corresponds to the first specified set of measurements.

3. The method as in claim 1, wherein the first specified set of measurements includes a distance between functional surfaces from a reference point and an angle of the functional surfaces.

4. The method as in claim 3, wherein the reference point is a centerline axis of the beam.

5. The method as in claim 2, wherein the actual first set of measurements are determined magnetically.

6. The method as in claim 5, wherein the measurements are carried out by a tracked vehicle moving along the beam.

7. The method as in claim 6, wherein the tracked vehicle carries out the reworking of the connection points.

8. The method as in claim 1, further comprising allowing the beam to reach an equilibrium shrinkage or deformation prior to reworking the connection points.

9. The method as in claim 8, wherein the beam is a precise concrete beam and is allowed to set for at least about 60 days at the production facility before rework of the connection points.

10. The method as in claim 1, wherein material is added or removed from the beam at the connection points.

11. The method as in claim 1, wherein material is added or removed from a console between the beam and the appurtenances at the connection points.

12. The method as in claim 1, wherein material is added or removed from the functional surfaces at the connection points.

13. The method as in claim 1, wherein material is added or removed from the appurtenances at the connection points.

14. The method as in claim 1, further comprising connecting the appurtenances to the beam at the connection points before erection of the beam at the construction site.

15. The method as in claim 1, wherein material is added at the connection points by one of welding, and the addition of spacer plates or material.

* * * * *